US008474391B1

(12) United States Patent
Hagen

(10) Patent No.: US 8,474,391 B1
(45) Date of Patent: Jul. 2, 2013

(54) TROLLING PLATE ASSEMBLY

(76) Inventor: Kevin H. Hagen, Mitchell, SD (US)

( * ) Notice: Subject to any disclaimer, the term of this patent is extended or adjusted under 35 U.S.C. 154(b) by 15 days.

(21) Appl. No.: 13/396,542

(22) Filed: Feb. 14, 2012

(51) Int. Cl.
*B63H 25/44* (2006.01)

(52) U.S. Cl.
USPC ..... 114/145 A

(58) Field of Classification Search
USPC ..... 114/145 R, 145 A
See application file for complete search history.

(56) References Cited

U.S. PATENT DOCUMENTS

| | | | | |
|---|---|---|---|---|
| 1,596,009 | A * | 8/1926 | Evinrude | 440/66 |
| 5,127,353 | A | 7/1992 | Wieser | |
| 5,711,241 | A | 1/1998 | Dyer | |
| 5,715,768 | A | 2/1998 | Anderson | |
| 5,924,378 | A | 7/1999 | Peterson | |
| 6,073,570 | A | 6/2000 | Stirtz | |
| 6,161,492 | A | 12/2000 | Dryer | |

* cited by examiner

*Primary Examiner* — Edwin Swinehart
(74) *Attorney, Agent, or Firm* — David J. Wilson

(57) ABSTRACT

The invention relates to a trolling plate assembly that uses a novel and non-obvious cam mechanism that is easy for the user to engage and re-engage when needed but also permits the trolling plate to lift automatically when the force of water from the outboard motor increases past a user adjustable predetermined point.

20 Claims, 6 Drawing Sheets

TROLLING PLATE ASSEMBLY

BACKGROUND OF INVENTION

Trolling plates are devices used to decrease the trust of a boat caused by outboard motors. Users want to decrease the thrust generated by an outboard motor to slow the boat to which it is attached to a slow speed, also called a trolling speed. Trolling plates are generally moved from a horizontal position when not in use to a vertical or near vertical position when in use. The slow or trolling speed is that speed at which a user wants the boat to travel when trolling for fish or, when trolling fishing bait behind a boat. However, when there is too much force caused by the outboard motor, the trolling plate must be removed from the vertical position or damage may be caused to the trolling plate or outboard motor.

In the prior art, trolling plates are known, however, they are not satisfactory for a number of reasons. For example, one version utilizes a pivoting plate that blocks the flow of water from the propeller of the outboard motor. When too much force is generated a shear pin is sheared and the plate is allowed to go into the up position, away from the flow of water. See, U.S. Pat. No. 5,127,353 to Wieser). The shear pin must be replaced before the unit is ready to function again. The disadvantages of this design are 1) the shear pin is hard to replace and the user must go to shore to do so. 2) the shear pin design does not have a reliable breaking point.

Another prior art version of the trolling plate utilizes a spring loaded plate. When the plate is activated by the user, the spring is engaged until the user disengages it. The disadvantages of this design are 1), when the operator (user) needs to get out of a tight spot when trolling the spring version does not react fast enough to give the motor enough power and steering control. 2) if the operator forgets to disengage the trolling plate and travels at non-trolling speeds, there will be unnecessary drag put on the outboard motor. If left down for an extended period of time, it could cause damage to the outboard motor. What is needed in the art is a trolling plate the responds automatically to increased force caused by the outboard motor and is easily re-engaged by the user when needed.

SUMMARY OF INVENTION

In one aspect, the invention relates to a trolling plate that uses a novel and non-obvious cam mechanism that is easy for the user to engage and re-engage when needed but also permits the trolling plate to lift automatically when the force of water from the outboard motor increases past a predetermined point. The predetermined point may be user adjustable. The term "outboard motor" when herein used refers to outboard motors, inboard motors and any other motor useful on a boat to cause thrust suitable to propel the boat through the water.

The trolling plate of the present invention is also termed the "trolling plate assembly." The trolling plate assembly comprises a bracket (16) for attachment of the trolling plate assembly (10) to a watercraft or watercraft means of propulsion, such as an outboard motor. The trolling plate assembly also comprises a trolling plate (12). The trolling plate or trolling plate member is a flat or essentially flat panel that is attached to the trolling plate bracket at a horizontal axis via a cam mechanism. The trolling plate is preferably square or rectangular but may also be of another shape such as round or oval. Such alternative shapes may be preferred depending on the size of boat or motor on which the trolling plate assembly will be used. Further, the trolling plate may have ridges or other designs for increased strength. Further still, the trolling plate may have one or more resealable or non-resealable holes to regulate speed. The trolling plate can be lowered to a vertical or near vertical position (see, FIG. 2) behind the outboard motor to impede the flow of water created by the outboard motor, thereby slowing the travel speed of the watercraft. The trolling plate can be raised manually to a horizontal or near horizontal position by the operator when it is not needed in the vertical position. The trolling plate can also be raised automatically upon increased water flow (i.e., thrust) from the outboard motor.

The cam mechanism of the trolling plate assembly of the present invention is located at a horizontal axis located at the "pivot point" between the bracket and the trolling plate at, for example (30). The trolling plate moves relative to the bracket at the horizontal axis. The cam mechanism at the horizontal axis comprises at least one cam pair (32 and 34) and preferable two cam pairs mounted on a shaft (30). Each cam pair comprises two intermeshed cams (32 and 34). The cams are designed such that the surfaces facing each other have four lobes and four indentations that intermesh. The lobes are spaced approximately 90 degrees (plus or minus between 0 to 2 degrees) from each other. The indentations are spaced approximately 90 degrees (plus or minus between 0 to 2 degrees) from each other. The lobes and indentations on any one cam are offset from each other by approximately 45 degrees. Although the preferred spacing between each of any two lobes or indentations is 90 degrees, other distances may be used. For example, five lobes and indentations may be used with spacing of approximately 72 degrees between any two adjacent lobes and any two adjacent indentations. One of ordinary skill in the art would be able to design other configurations, if desired, in view of the teachings of this specification.

The trolling plate assembly of the present invention may have one or more cam pairs. If a single cam pair is used then the spring (38) the creates the pressure to keep the cam blocks meshed will need to press against the cam block on one end and against a block (or similar fixed element) on the other end. In a preferred embodiment, the trolling plate assembly of the present invention has two cam pairs and the spring (38) is located in between the two cam pairs and is in contact (directly or indirectly) with both cam pairs.

The cams in any one cam pair are maintained in an intermeshed position by, for example, spring pressure. Thus, thrust from the outboard motor will not cause the cams to separate from each other until enough thrust is generated to overcome the pressure caused by the spring or springs generating the spring pressure. The desired amount of thrust that results in the separation of the cams in the cam pair can be calibrated for use with various size motors, if desired. In one embodiment, the trolling plate assembly of the present invention is manufactured or sold with a predetermined setting. In another embodiment, the cam mechanism of the trolling plate assembly of the present invention can be disassembled by the user or service person and recalibrate by replacement of the spring(s). In other words, different types of fishing may require different types and sizes of boats and motors and the ideal trolling speed may need to be adjusted. In yet another embodiment, the spring pressure can be adjusted by a screw mechanism that, when turned, will increase of decrease the pressure caused by the spring(s) by tightening or loosening the spring(s). Thus, in some instances that predetermined point at which the trolling plate automatically raises may be set at the point of manufacture or may be adjustable by a service person or user.

The cams (32 and 34) and spring (38) of the present invention may be mounted on a shaft (30). The shaft is located at the "horizontal axis" between the bracket and the trolling plate. In other words, it is located at the "pivot point" described above. The cams, shaft and spring(s) may be enclosed in a "cam housing," (14) also referred herein as a "cam tube." In order for the cams in any one cam pair to move relative to each other, one of the cams in the cam pair will need to be in a fixed position, relative to the other cam. Further, so that the cams in any one cam pair may separate from each other when appropriate force is applied, one of the cams in the cam pair will need to move or slide on the shaft. In other words, in an embodiment of the present invention, one cam of the cam pair is fixed relative, for example, to the cam housing and the other cam in the cam pair is fixed relative, for example, to the shaft in a rotational plane but can move horizontally along the shaft to the extent necessary to rotate relative to the fixed cam. For clarity, the two halfs of a cam pair (i.e., the fixed and movable or slidable cams) may be called cam blocks. The term "move relative to each other," or similar, means that the two blocks of a cam pair move at different rate such that one moves faster or father than the other. The "fixed cam" would be the cam block that moved the least amount. In a preferred embodiment, one cam in the cam pair is literally fixed in relation to the cam housing and the other cam in the cam pair is movable with regard to the fixed cam block. Additionally, the movable cam can move or slide along the shaft so that the two cam blocks of any cam pair cam separate or unmesh with each other.

The trolling plate assembly of the present invention may also comprise a lever (20) suitable for regulating the position of the trolling plate manually and for holding or "locking" the trolling plate in a fixed position, for example, in a horizontal position when not in use. The lever may have a "wedge key" (22) or other projection that can be reversibly inserted into an indentation (24) in, for example, the cam housing. The lever may be spring loaded (26) to keep the wedge key in the indentation until the lever is operated and the wedge key is removed from the indentation or recess. The lever may also have a rope or other extension for operator ease of use (see, FIG. 3). Once the wedge key is removed from the indentation (recess) the trolling plate may be raised or lowered by hand, as desired.

The trolling plate assembly of the present invention works, for example, as follows. When the trolling plate assembly is to be used, a user lifts the lever disengaging the wedge key of the lever from the recess in the cam housing. The trolling plate (12) can then be lowered into a vertical or near (essentially) vertical position (e.g., a first position) behind the outboard motor. In this situation, the cam housing and the cam blocks move in unison allowing the trolling plate to be lowered. The trolling plate is lowered to a vertical position with the lever engaging the wedge key into the next recess in the cam housing. The cams in the cam pairs do not separate. In this vertical position, the trust of the out board motor will be lessened because it will be dissipated by the impediment caused by the trolling plate. If the thrust caused by the outboard motor increases to a predetermined level; for example, if the user decides a burst of speed is needed to avoid a collision, the increased thrust caused by the outboard motor will cause an upward pressure on the trolling plate. The upward pressure will cause the compression of the spring(s) (38) which hold the meshed cams of the any one or more cam pairs together to increase; the meshed cams to separate (see, FIG. 5B) and the thereby allow the trolling plate to be pushed up by the thrust of the outboard motor. In this situation, the movable cams (32) rotate along with the shaft (30) and the trolling plate (12) but the cam housing (14) and the fixed cams (34) remain stationary. Once the cams in the any one or more cam pairs reach the half-way point, that is, the lobes of the fixed cam align with the lobes of the rotating cam, the pressure cause by the spring(s) will push the lobes of the fixed cam of the cams in the cam pair into the indentations of the rotating cam of the cam pair (i.e., the cams remesh), thereby holding the trolling plate in a near (essentially) horizontal position (e.g., a second position). The description above is one example of how the present invention may be used. One of ordinary skill in the art, in view of the teachings of the present invention, will be able to envision variations of the above example that fall into the scope of the present invention. For the purposes of this specification, the fixed cam may be referred to as the first cam or the second cam and the rotating or movable cam may be referred to as the first or second cam, so long as any one (fixed or rotating) is called the first cam and the other cam is called the second cam. Also, for the purposes of this specification, the terms "fixed cam" and "rotating cam" are relative terms. The "fixed cam" may be immobile, may be slightly mobile or may move as much as the "rotating cam." Likewise, the "rotating cam" may be mobile (i.e., rotate) or slightly mobile (i.e., rotating a small amount). Still, both cams may move an equal or essentially equal amounts albeit in opposite directions.

The trolling plate of the present invention also allows for "feathering." That is, the trolling plate may move upwards as the water craft increases speed but not enough to cause it to automatically move into the horizontal position. Then, as the water craft slows, the trolling plate will return to the vertical position.

The trolling plate assembly of the present invention is not limited by the materials from which it is made. In a preferred embodiment, the trolling plate assembly is made from non-ferrous metal, preferably aluminum or other corrosion resistant metal such as stainless steel. In some embodiments, portions of the trolling plate assembly are made from plastic, such as high impact plastic. For example, the trolling plate may be made of plastic. In another embodiment, the cams are made of nylon because of it is self-lubricating or is "slippery." That is, it is a low friction material. The cams may also be made of brass or bronze because it is also "self-lubricating," that is; it is a low friction metal. Brass is also corrosion resistant, especially so-called dezincification resistant brasses. The trolling plate assembly may be assembled with nuts and bolts, screws, welding or any other means known to those skilled in metal and plastic fabrication.

The moving parts of the trolling plate assembly, unless made of self-lubricating-type materials, or in addition to being made of self-lubricating materials, may be lubricated by means of oils or greases. In one embodiment, the cam housing may have ports or fittings (e.g., grease fittings) to permit the lubrication of the cam mechanism. In another embodiment, the cam mechanism is permanently lubricated in a sealed cam housing and lubricated with or packed with high quality grease. In yet another embodiment, the cam housing is filed with oil, such a s 90W oil and the cam housing has a sealable filling hole. The cam housing is preferably sealed from water entering or lubricants leaking by the use of O-rings (40) or double O-rings at the ends of the housing, as shown in FIGS. 5A and 5B.

The trolling plate assembly of the present invention is not limited by size. One of ordinary skill in the art will be able to design and build a trolling plate based on the teachings of the present invention suitable for use with various sized motors and water craft. In brief, larger motors (and, usually, larger water craft) may require larger trolling plate assemblies to lower the trust of the motor to slow the water craft to a speed suitable for trolling. Further, the spring tension may be adjustable to make the trolling plate assembly of the present invention adaptable to use of different sized water craft and/or boats or different user desired trolling speeds.

In one embodiment, the trolling plate assembly of the present invention comprises: a bracket (16 and 18) attachable to a water craft propulsion unit or to a water craft; a trolling plate that is reversibly pivotable about a horizontal axis; a cam mechanism positioned at said horizontal axis and connectivity linked to said bracket and said trolling plate, said cam mechanism comprising at least one cam pair, each cam pair comprising first and second inter-meshable cams held in a first meshed position by spring pressure, wherein said first and second inter-meshable cams are separated and rotate relative to each other when pressure is applied to said trolling plate and remesh in a second meshed position when said second position is reached. Further, with regard to the trolling plate assembly of the present invention, when said cams are in the first meshed position said trolling plate is in a vertical or near vertical position and when said cams are in the second meshed position said trolling plate is in a horizontal or near horizontal position. Further still, with regard to the trolling plate assembly of the present invention, the first meshed position and said second meshed position are separated by approximately 90 degrees. Further still, with regard to the trolling plate assembly of the present invention, the cam mechanism is located in a cam housing. Further still, with regard to the trolling plate assembly of the present invention, the cam mechanism additionally comprises a shaft along which said at least one cam pair along which one or more springs are positioned inside said cam housing. Further still, with regard to the trolling plate assembly of the present invention, the trolling plate assembly additionally comprises a lever assembly having a wedge key, the lever assembly connected to said bracket and, additionally, the cam housing having one or more recesses into which the wedge key of the lever can be reversibly inserted, such that when the wedge key is inserted into one said cam housing said cam housing cannot be moved or rotated. Further still, with regard to the trolling plate assembly of the present invention, the wedge key of the lever is maintained in the recess by spring pressure. Further still, with regard to the trolling plate assembly of the present invention, the first cam is in a fixed position and the second cam rotates relative to said first cam. Yet further still, with regard to the trolling plate assembly of the present invention, the water craft propulsion unit is an outboard or inboard motor. Yet further still, with regard to the trolling plate assembly of the present invention, the cam mechanism comprises two cam pairs. Yet further still, with regard to the trolling plate assembly of the present invention, the two cam pairs are separated by at least one spring. Yet further still, each cam pair comprises one fixed and one movable cam block. Yet further still, the fixed cam blocks are located external to said movable cam blocks along said shaft. Yet further still, the cam housing is sealed with O-rings.

In another embodiment of the present invention, the trolling plate assembly of the present invention comprises: a bracket attachable to a water craft propulsion unit or to a water craft; a trolling plate that is reversibly pivotable about a horizontal axis; a cam mechanism positioned at said horizontal axis and connectivity linked to said bracket and said trolling plate, said cam mechanism comprising at least two cam pairs, each cam pair comprising first and second inter-meshable cams held in a first meshed position by spring pressure, wherein said first and second inter-meshable cams are separated and rotate relative to each other when pressure is applied to said trolling plate and remesh in a second meshed position when said second position is reached. Further, with regard to the trolling plate assembly of the present invention, when the cams are in the first meshed position said trolling plate is in a vertical or near vertical position and when the cams are in the second meshed position said trolling plate is in a horizontal or near horizontal position. Further still, the first meshed position and the second meshed position are separated by approximately 90 degrees. Further still, with regard to the trolling plate assembly of the present invention, the cam mechanism is located in a cam housing. Further still, with regard to the trolling plate assembly of the present invention, the cam mechanism additionally comprises a shaft along which the cam pairs along which one or more springs are positioned inside the cam housing. Yet further still, with regard to the trolling plate assembly of the present invention, the trolling plate assembly additionally comprises a lever assembly having a wedge key, the lever assembly connected to the bracket and, additionally, the cam housing having one or more recesses into which the wedge key of the lever can be reversibly inserted, such that when the wedge key is inserted into one recess the cam housing cannot be moved or rotated about the horizontal axis and the wedge key of the lever is maintained in the recess by spring pressure.

Other features and advantages of the invention will be apparent from the following description.

DETAILED DESCRIPTION OF PREFERRED EMBODIMENTS

The invention will now be described in detail with reference to a few preferred embodiments, as illustrated in accompanying drawings. In the following description, numerous specific details are set forth in order to provide a thorough understanding of the invention. However, it will be apparent to one skilled in the art that the invention may be practiced without some or all of these specific details. In other instances, well-known features and/or process steps have not been described in detail in order to not unnecessarily obscure the invention. The features and advantages of the invention may be better understood with reference to the drawings and discussions that follow.

While the invention has been described with respect to a limited number of embodiments, those skilled in the art, having benefit of this disclosure, will appreciate that other embodiments can be devised which do not depart from the scope of the invention as disclosed herein.

Figure 1:
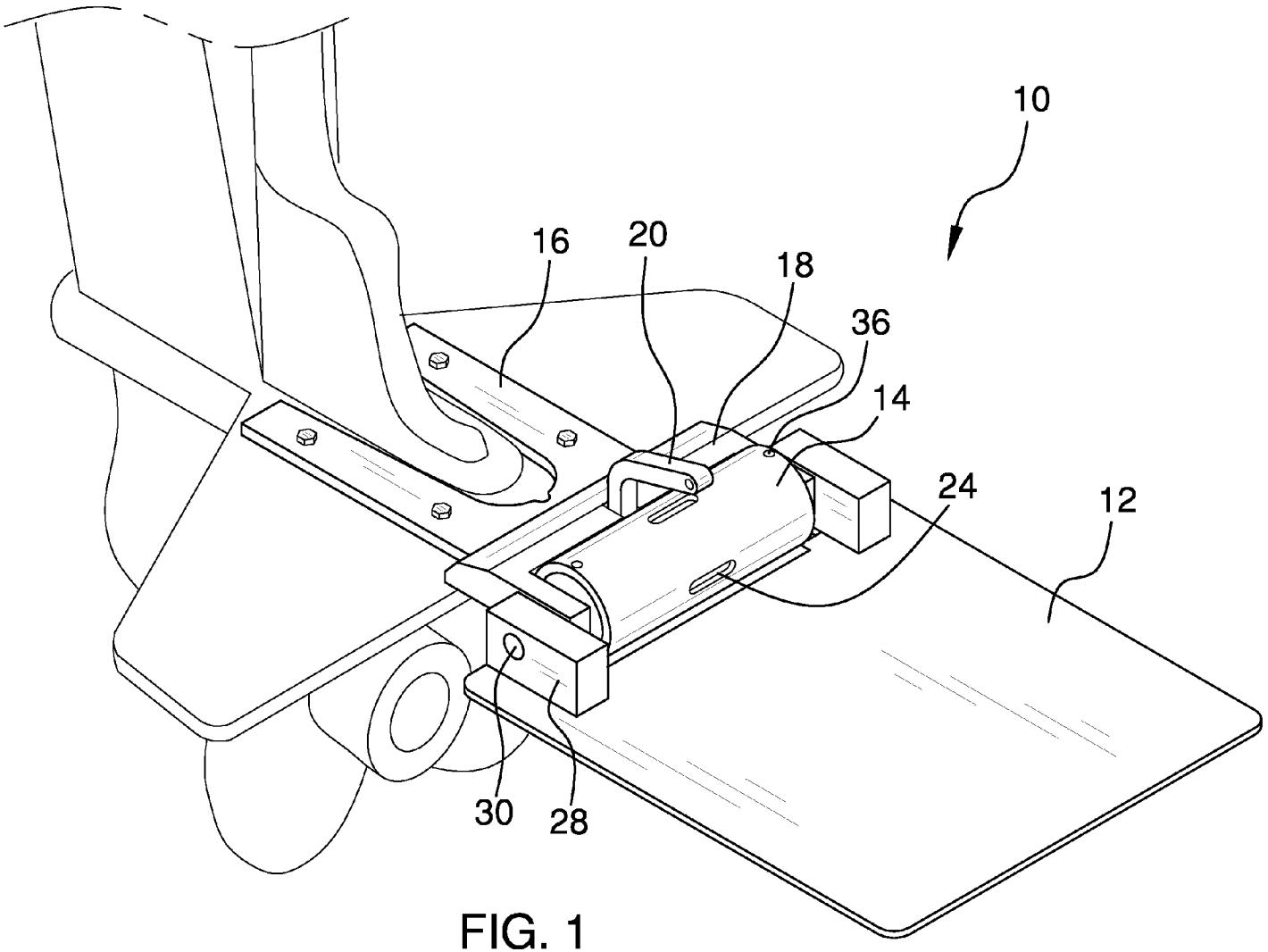
FIG. 1 shows a perspective view of the trolling plate assembly of the pending invention with the trolling plate in a raised (horizontal) position.

FIG. 1 is a perspective view of the trolling plate assembly (10) of the present invention. Shown are the base plate (16) (or mounting plate) on which is attached the mounting block (18), the release handle (20), the cam housing (14) and the trolling plate (12) or trolling plate member. In this figure the trolling plate is shown in the raised position wherein it would not impede the flow of water from the outboard motor.

Figure 2:
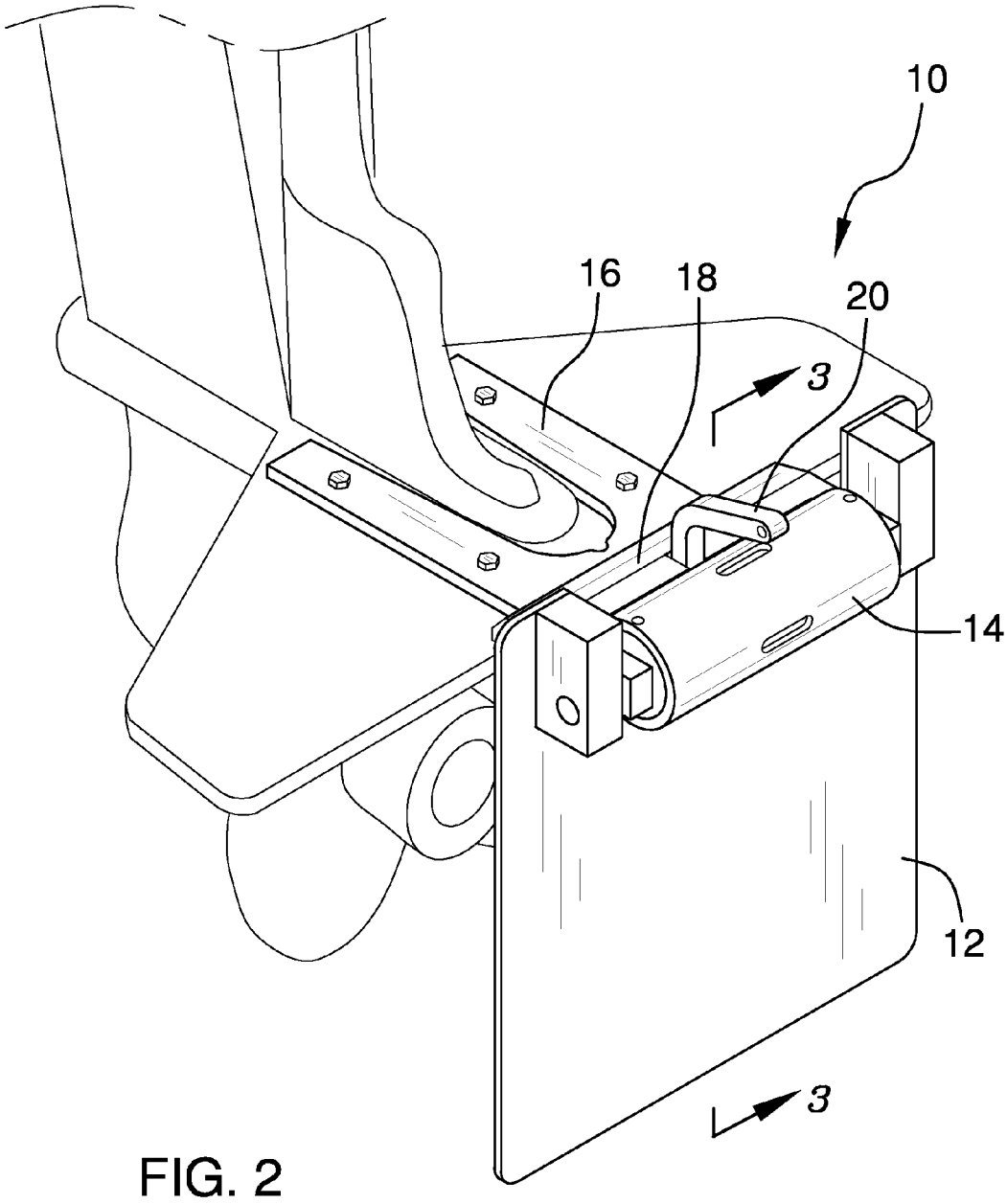
FIG. 2 shows a perspective view of the trolling plate assembly of the pending invention with the trolling plate in a lowered (vertical) position.

FIG. 2 shows another perspective view of the trolling plate assembly of the present invention. Shown are the base plate (16), mounting block (18), release handle (20), cam housing (14) and trolling plate (12) in the lowered position wherein it would impede the flow of water from the outboard motor.

Figure 3:
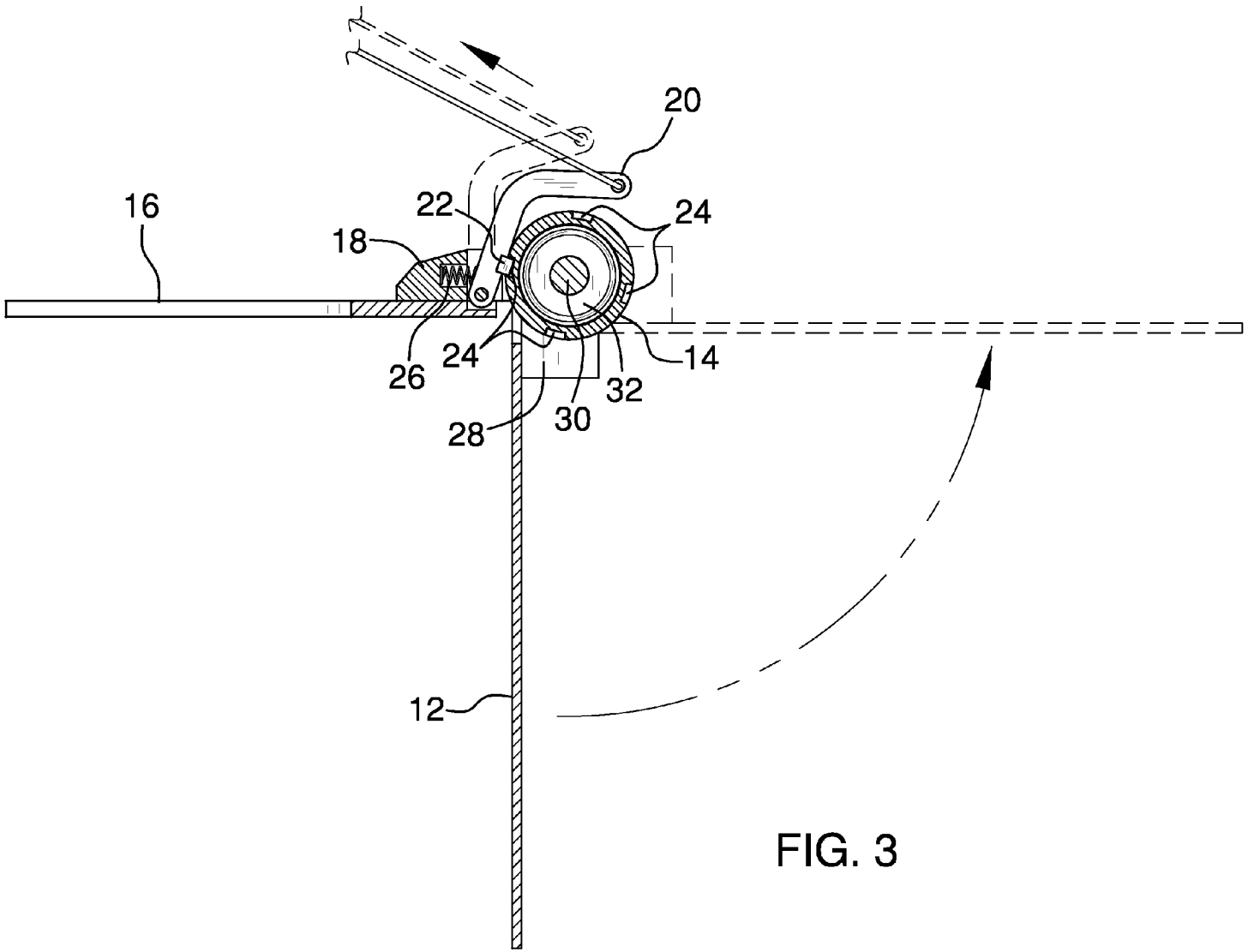
FIG. 3 shows a cross-sectional view of the trolling plate assembly of the pending invention that indicates operational movement in the device.

FIG. 3 shows a cross-sectional view of the trolling plate assembly of the present invention. Visible are the base plate (16), the mounting block (18), the release handle (20) or cam lever, the cam wedge (22) and recesses on the cam housing (24), the cam tube or cam housing (14), the cam shaft or shaft (30), one movable cam block (32) or cam half, the trolling plate (12) and the release handle spring (26). The broken line images show the trolling plate assembly in the raised or horizontal position whereas the solid line images show the trolling plate assembly in the lowered or vertical position.

Figure 4:
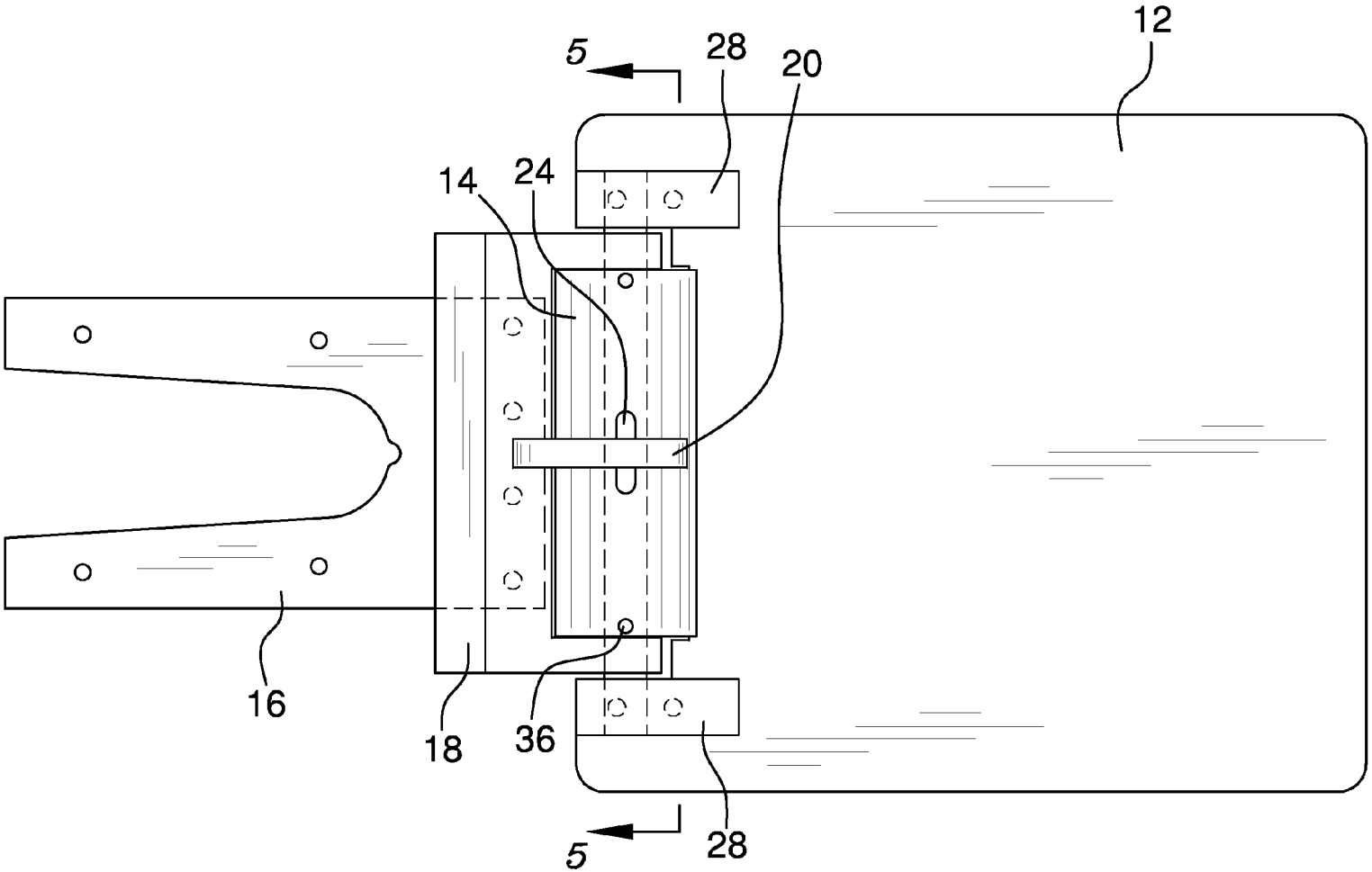
FIG. 4 shows a top view of the trolling plate assembly of the present invention.

FIG. 4 shows a top view of the trolling plate assembly (10) of the present invention. The figure is labeled as those described above.

Figure 5A:
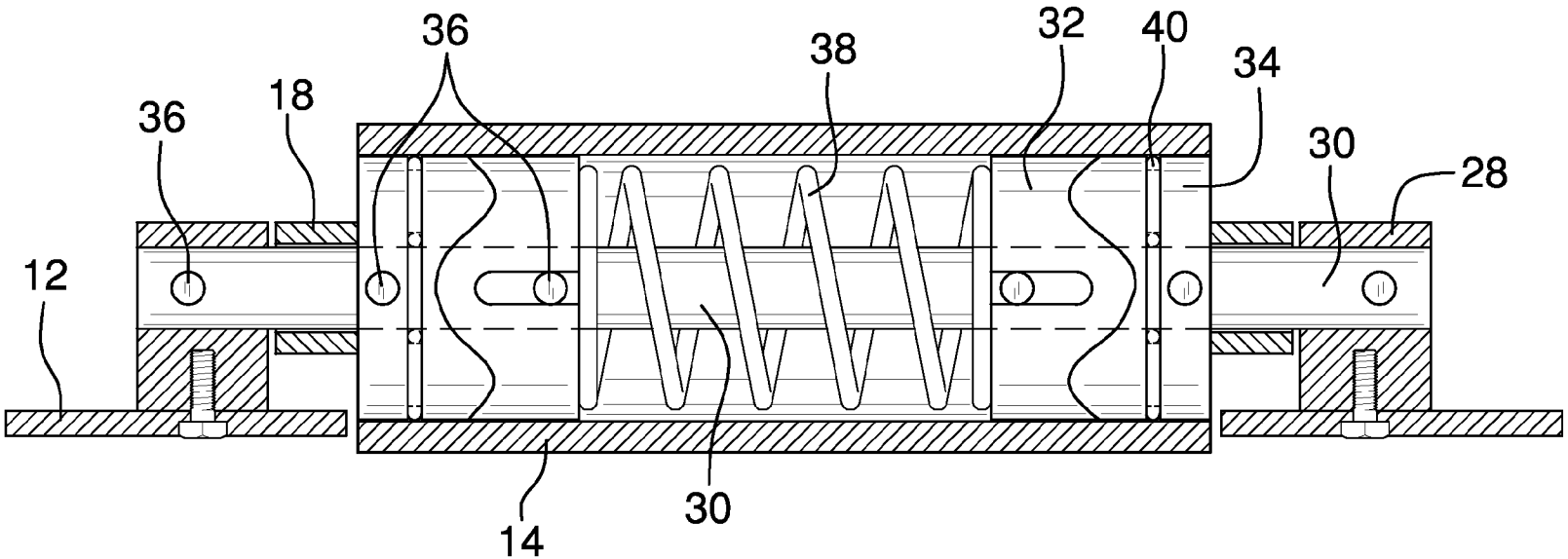
FIG. 5A shows a cross-sectional view of the cam housing of the present invention with the cams in the meshed or intermeshed position.

FIG. 5A is a cross-section view of the cam housing or cam tube of the trolling plate assembly of the present invention. The figure shows the trolling plate (12), mounting block (18), various dowel pins (36), the stationary (or fixed) cam blocks (34), the sliding (or movable) cam blocks (32), the cam shaft (30), a cam spring (38) and an O-ring (40) to seal the cam housing (14). The trolling plate assembly (10) as viewed in FIG. 5A shows the cam blocks meshed (or remeshed after movement of the trolling plate).

Figure 5B:
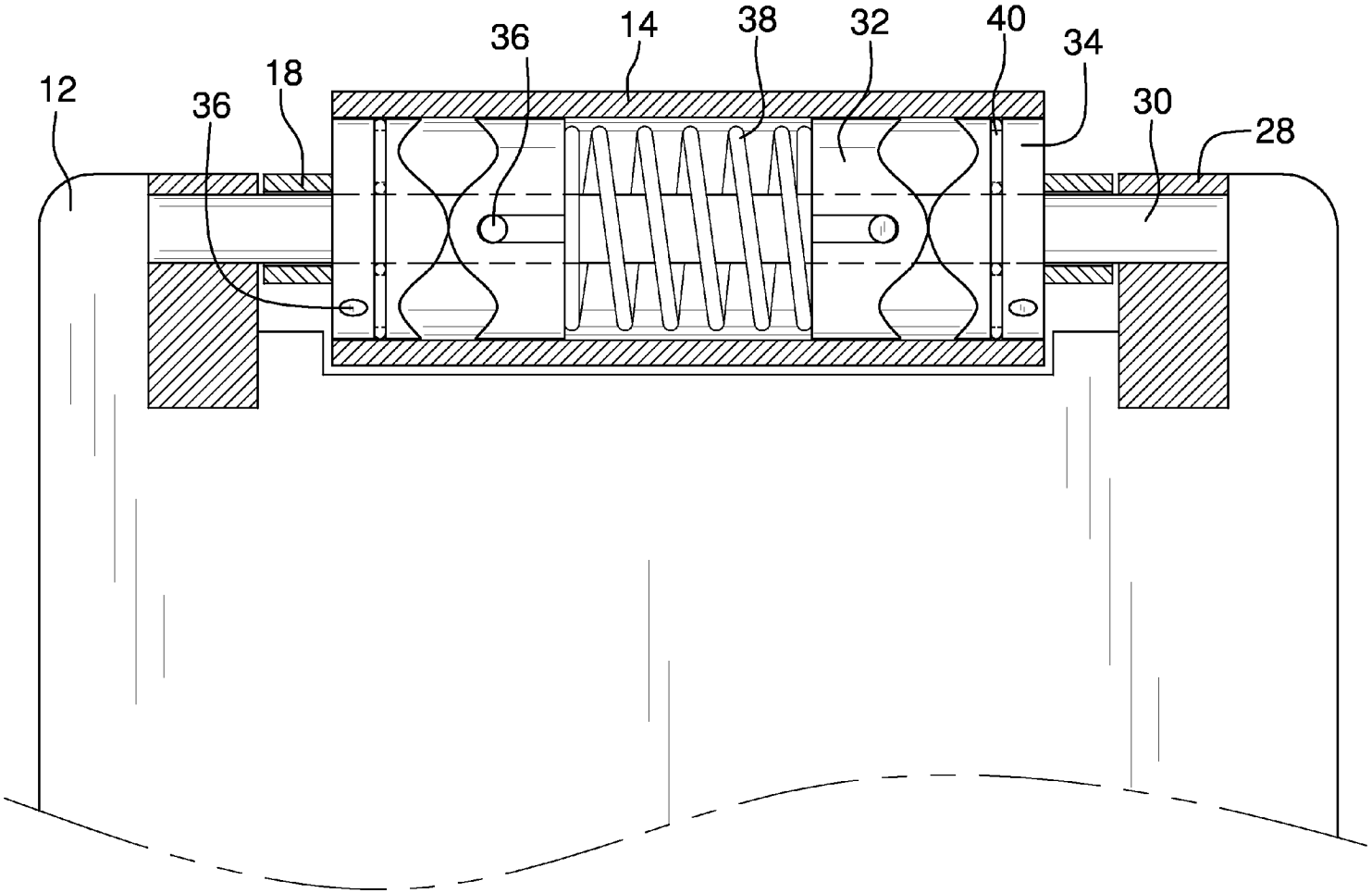
FIG. 5B shows a cross-sectional view of the cam housing of the present invention with the cams in the non-meshed or separated position.

FIG. 5B shows a cross-sectional view of the cam housing or cam tube with the cam blocks in the non-intermeshed configuration and with the fixed or stationary cam block move 45 degrees relative to the sliding or movable cam block. The trolling plate would be half-way between a raised (horizontal) and a lowered (vertical) position in the figure. The figure is labeled as above.

What is claimed is:

1. A trolling plate assembly, comprising:

a. a bracket attachable to a water craft propulsion unit or to a water craft;

b. a trolling plate that is reversibly pivotable about a horizontal axis;

c. a cam mechanism positioned at said horizontal axis and connectivity linked to said bracket and said trolling plate, said cam mechanism comprising at least one cam pair, each cam pair comprising first and second inter-meshable cams held in a first meshed position by spring pressure, wherein said first and second inter-meshable cams are separated and rotate relative to each other when pressure is applied to said trolling plate and remesh in a second meshed position when said second position is reached.

2. The trolling plate assembly of claim 1, wherein when said cams are in the first meshed position said trolling plate is in a vertical or near vertical position and when said cams are in the second meshed position said trolling plate is in a horizontal or near horizontal position.

3. The trolling plate assembly of claim 1, wherein said first meshed position and said second meshed position are separated by approximately 90 degrees.

4. The trolling plate of claim 1, wherein said cam mechanism is located in a cam housing.

5. The trolling plate of claim 4, wherein said cam mechanism additionally comprises a shaft along which said at least one cam pair along and which one or more springs are positioned inside said cam housing.

6. The trolling plate assembly of claim 4, wherein said trolling plate assembly additionally comprises a lever assembly having a wedge key, said lever assembly connected to said bracket and, additionally, said cam housing having one or more recesses into which the wedge key of the lever can be reversibly inserted, wherein when said wedge key is inserted into one said cam housing said cam housing cannot be moved.

7. The trolling plate of claim 6, wherein said wedge key of said lever is maintained in said recess by spring pressure.

8. The trolling plate of claim 1, wherein said first cam is in a fixed position and said second cam rotates relative to said first cam.

9. The trolling plate of claim 1, wherein said water craft propulsion unit is an outboard motor.

10. The trolling plate assembly of claim 4, wherein said cam mechanism comprises two cam pairs.

11. The trolling plate assembly of claim 10, wherein said two cam pairs are separated by at least one spring.

12. The trolling plate assembly of claim 10, wherein each cam pair comprises one fixed and one movable cam block.

13. The trolling plate assembly of claim 12, wherein said fixed cam blocks are located external to said movable cam blocks along said shaft.

14. The trolling plate assembly of claim 1, wherein said cam housing is sealed with O-rings.

15. A trolling plate assembly, comprising:

a. a bracket attachable to a water craft propulsion unit or to a water craft;

b. a trolling plate that is reversibly pivotable about a horizontal axis;

c. a cam mechanism positioned at said horizontal axis and connectivity linked to said bracket and said trolling plate, said cam mechanism comprising at least two cam pairs, each cam pair comprising first and second inter-meshable cams held in a first meshed position by spring pressure, wherein said first and second inter-meshable cams are separated and rotate relative to each other when pressure is applied to said trolling plate and remesh in a second meshed position when said second position is reached.

16. The trolling plate assembly of claim 15, wherein when said cams are in the first meshed position said trolling plate is in a vertical or near vertical position and when said cams are in the second meshed position said trolling plate is in a horizontal or near horizontal position.

17. The trolling plate assembly of claim 15, wherein said first meshed position and said second meshed position are separated by approximately 90 degrees.

18. The trolling plate of claim 15, wherein said cam mechanism is located in a cam housing.

19. The trolling plate of claim 18, wherein said cam mechanism additionally comprises a shaft along which said two or more one cam pairs and along which one or more springs are positioned inside said cam housing.

20. The trolling plate assembly of claim 19, wherein said trolling plate assembly additionally comprises a lever assembly having a wedge key, said lever assembly connected to said bracket and, additionally, said cam housing having one or more recesses into which the wedge key of the lever can be reversibly inserted, wherein when said wedge key is inserted into one said cam housing said cam housing cannot be moved and, wherein said wedge key of said lever is maintained in said recess by spring pressure.

* * * * *